US008100200B2

(12) United States Patent
Wolfer

(10) Patent No.: US 8,100,200 B2
(45) Date of Patent: Jan. 24, 2012

(54) CHUCK ASSEMBLY FOR A DOWN-HOLE DRILL

(75) Inventor: Dale Richard Wolfer, Salem, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 223 days.

(21) Appl. No.: 12/622,189

(22) Filed: Nov. 19, 2009

(65) Prior Publication Data

US 2010/0264608 A1 Oct. 21, 2010

Related U.S. Application Data

(63) Continuation-in-part of application No. 12/425,222, filed on Apr. 16, 2009, now abandoned.

(51) Int. Cl.
*E21B 10/36* (2006.01)

(52) U.S. Cl. ..... 175/300; 175/321; 175/415

(58) Field of Classification Search ..... 175/300, 175/320, 321, 414, 415
See application file for complete search history.

(56) References Cited

U.S. PATENT DOCUMENTS

| | | | | |
|---|---|---|---|---|
| 4,706,764 | A | 11/1987 | Hughes | |
| 4,962,822 | A * | 10/1990 | Pascale | 175/258 |
| 5,139,095 | A | 8/1992 | Lyon et al. | |
| 5,240,083 | A | 8/1993 | Lyon | |
| 5,325,926 | A | 7/1994 | Lay et al. | |
| 5,390,749 | A | 2/1995 | Lyon | |
| 5,562,170 | A | 10/1996 | Wolfer et al. | |
| 5,566,771 | A | 10/1996 | Wolfer et al. | |
| 5,647,447 | A | 7/1997 | Jones | |
| 5,699,867 | A | 12/1997 | Jones | |
| 5,711,205 | A | 1/1998 | Wolfer et al. | |
| 5,735,358 | A | 4/1998 | Lyon | |
| 5,794,516 | A | 8/1998 | Wolfer et al. | |
| 6,789,632 | B2 | 9/2004 | Green | |
| 6,810,974 | B2 | 11/2004 | Lyon et al. | |
| 6,827,162 | B2 | 12/2004 | Fisher | |
| 7,267,185 | B2 | 9/2007 | Underwood et al. | |
| 7,467,675 | B2 | 12/2008 | Lay | |
| 2004/0016574 | A1 | 1/2004 | Green | |
| 2008/0078584 | A1 * | 4/2008 | Lyon | 175/171 |

OTHER PUBLICATIONS

Office Action from U.S. Appl. No. 12/425,222, dated Sep. 29, 2010 (8 pages).

* cited by examiner

*Primary Examiner* — William P Neuder
(74) *Attorney, Agent, or Firm* — Michael Best & Friedrich LLP

(57) ABSTRACT

A chuck assembly, an assembly for an earth-boring drill assembly, and a method of retaining a drill bit for an earth-boring drill assembly, the drill assembly including a casing. The assembly includes a drill bit having a generally cylindrical head, a chuck connectable to the casing and operable to support the bit, the chuck having an outer surface with a radially-outwardly extending chuck ridge, an axially-extending first slot being defined in the ridge, a sleeve having an inner surface with a radially-inwardly extending sleeve ridge engageable with the chuck ridge to limit axial movement of the sleeve relative to the chuck, the sleeve having a first lug supported on the inner surface, the first lug being positionable in the first slot to limit relative rotational movement between the sleeve and the chuck. The assembly may also include a retainer assembly provided between the sleeve and the bit.

24 Claims, 6 Drawing Sheets

CHUCK ASSEMBLY FOR A DOWN-HOLE DRILL

RELATED APPLICATION

The present patent application is a continuation-in-part of and claims the benefit of prior-filed, co-pending U.S. patent application Ser. No. 12/425,222, filed Apr. 16, 2009, the entire contents of which is hereby incorporated by reference.

FIELD OF THE INVENTION

The present invention relates to down-hole drills and, more particularly, a chuck assembly for such a drill.

SUMMARY OF THE INVENTION

Down-hole drills, also known as down-hole hammers, down-the-hole (DTH) drills, and earth-boring drills, are typically fluid-operated and generally include a casing, a piston movably disposed within the casing, and a cutting bit with a cutting surface movably coupled with the casing. The piston is linearly reciprocated within the casing to repeatedly impact the bit so as the drive the cutting surface into a work surface of a hole being drilled. Typically, such drills further include a chuck threaded to the casing and for guiding the movement of the bit and/or the piston. The bit may be movably disposed within a central bore of the chuck, and the bit and chuck have complementary grooves and splines that slidably interact during movement of the bit. Further, the bit is generally secured to the chuck by means of a set of split rings that engage with the outer surface of the bit, such as with a bit groove or shoulder, so as to connect the bit with the chuck.

When a bit breaks during drilling operations, an operator must remove the broken pieces of the bit from a hole before drilling can continue. This process can be time consuming and expensive and, if unsuccessful, can result in abandonment of the hole being drilled. It may be important to provide structure to retain the broken portion of the bit with the rest of the drilling assembly so that the broken portion can be retrieved from the hole without undue delay and expense. Such structure should also be reliable.

Also, when a bit breaks, it may be difficult to disconnect the chuck from the remainder of the drill assembly. It may be important to provide structure to facilitate easy removal of the chuck. Such structure may be useful even when the bit is intact.

In one embodiment, the invention may provide a chuck assembly for an earth-boring drill assembly, the drill assembly including a casing having a central axis, and an earth-boring bit. The chuck assembly may generally include a chuck connectable to the casing and operable to support the earth-boring bit, the chuck having an outer surface with a radially-outwardly extending chuck ridge, and an annular sleeve positionable on the chuck, the sleeve having an inner surface with a radially-inwardly extending sleeve ridge engageable with the chuck ridge to limit axial movement of the sleeve relative to the chuck. One of the chuck and the sleeve defines an axially-extending slot, and the other of the chuck and the sleeve has a lug, the lug being positionable in the slot to limit relative rotational movement between the sleeve and the chuck.

In some constructions, the lug has a width, and the slot is sized to closely fit the width of the lug. The lug chuck may define the axially-extending slot in the chuck ridge, and the sleeve may support the lug on the inner surface.

In some constructions, the chuck defines a plurality of axially-extending slots in the chuck ridge, the plurality of axially-extending slots being spaced about a circumference of the chuck, and the sleeve supports a plurality of lugs on the inner surface, the plurality of lugs being spaced about a circumference of the inner surface of the sleeve to correspond to positions of the plurality of axially-extending slots, each of the plurality of lugs being positionable in a corresponding one of the plurality of axially-extending slots. In one construction, the chuck defines four axially-extending slots, and the sleeve supports four lugs.

In some constructions, the chuck assembly may further include a bit retainer assembly provided at least partially by the sleeve, the bit retainer assembly including one of an axial retainer slot defined by the sleeve and engageable by a retainer lug supported on the bit, and a retainer lug supported by the sleeve and engageable in an axial retainer slot defined by the bit, the retainer slot having an axially-extending side wall defining an opening and an axial end wall, and the retainer lug being positionable in the retainer slot through the opening in the side wall, the retainer lug being engageable with the end wall to restrict axial movement of the bit from the sleeve and away from the casing.

In another embodiment, the invention may provide an assembly for an earth-boring drill assembly, the drill assembly including a casing having a central axis. The assembly may generally include a drill bit including a generally cylindrical head, a chuck connectable to the casing and operable to support the bit, the chuck having an outer surface with a radially-outwardly extending chuck ridge, a sleeve having an inner surface with a radially-inwardly extending sleeve ridge engageable with the chuck ridge to limit axial movement of the sleeve relative to the chuck, one of the chuck and the sleeve defining an axially-extending first slot, the other of the chuck and the sleeve having a first lug, the first lug being positionable in the first slot to limit relative rotational movement between the sleeve and the chuck, and a retainer assembly provided between the sleeve and the bit. The retainer assembly may include an axial retainer slot defined by one of the sleeve and the bit, the retainer slot having an axially-extending side wall defining an opening and an axial end wall, and a retainer lug supported on the other of the sleeve and the bit, the retainer lug being positionable in the retainer slot through the opening in the side wall, the retainer lug being engageable with the end wall to restrict axial movement of the bit from the sleeve and away from the casing.

In some constructions, the chuck defines the axially-extending first slot in the chuck ridge, and the sleeve supports the first lug on the inner surface. In some constructions, the bit defines the retainer slot, and the sleeve supports the retainer lug. The first lug may be circumferentially spaced from the retainer lug by at least about 30 degrees and, generally, by about 45 degrees. The first lug may be axially spaced from the retainer lug.

In some constructions, the chuck may define a plurality of axially-extending first slots in the chuck ridge, the plurality of axially-extending first slots being spaced about a circumference of the chuck, and the sleeve may support a plurality of first lugs on the inner surface, the plurality of first lugs being spaced about a circumference of the inner surface of the sleeve to correspond to positions of the plurality of axially-extending first slots, each of the plurality of first lugs being positionable in a corresponding one of the plurality of axially-extending first slots. In some constructions, the bit may define a plurality of axially-extending retainer slots, the plurality of axially-extending retainer slots being spaced about a circumference of the bit, and the sleeve may support a plurality of retainer lugs on the inner surface, the plurality of retainer lugs being spaced about a circumference of the inner surface of the sleeve to correspond to positions of the plurality of axially-extending retainer slots, each of the plurality of retainer lugs being positionable in a corresponding one of the plurality of axially-extending retainer slots.

In one construction, the chuck defines four axially-extending first slots in the chuck ridge, and the sleeve supports four first lugs. In one construction, the bit defines four axially-extending retainer slots, and the sleeve supports four retainer lugs. The first lugs and the retainer lugs may be offset by about 45 degrees.

In some constructions, the retainer lug may pass through the first slot before being positioned in the retainer slot. The retainer assembly may further include an entry slot defined by the bit and communicating with the first slot, the retainer lug passing through the first slot and into the entry slot. The retainer assembly may also include a transverse slot communicating between the entry slot and the retainer slot, the transverse slot extending at least partially circumferentially about the bit, the transverse slot communicating with the retainer slot through the opening in the side wall of the retainer slot, the retainer lug being movable from the entry slot, into and through the transverse slot, and into the retainer slot.

In a further embodiment, the invention provides a method of retaining a drill bit for an earth-boring drill assembly, the drill assembly including a casing having a central axis, a drill bit including a generally cylindrical head, a chuck having an outer surface with a radially-outwardly extending chuck ridge, an axially-extending first slot being defined in the ridge, a sleeve having an inner surface with a radially-inwardly extending sleeve ridge and a first lug supported on the inner surface, and a retainer assembly including an axial retainer slot defined by one of the sleeve and the bit, the retainer slot having an axially-extending side wall defining an opening and an axial end wall, and a retainer lug supported on the other of the sleeve and the bit. The method may generally include connecting the bit to the chuck, positioning the sleeve on the chuck, the chuck being connectable to the casing, engaging the retainer assembly including positioning the retainer lug in the retainer slot through the opening in the side wall, the retainer lug being engageable with the end wall to restrict axial movement of the bit from the sleeve and away from the casing, and engaging the first lug in the first slot to limit relative rotational movement between the sleeve and the chuck.

One or more independent aspects of the invention will become apparent by consideration of the detailed description, claims and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 4:
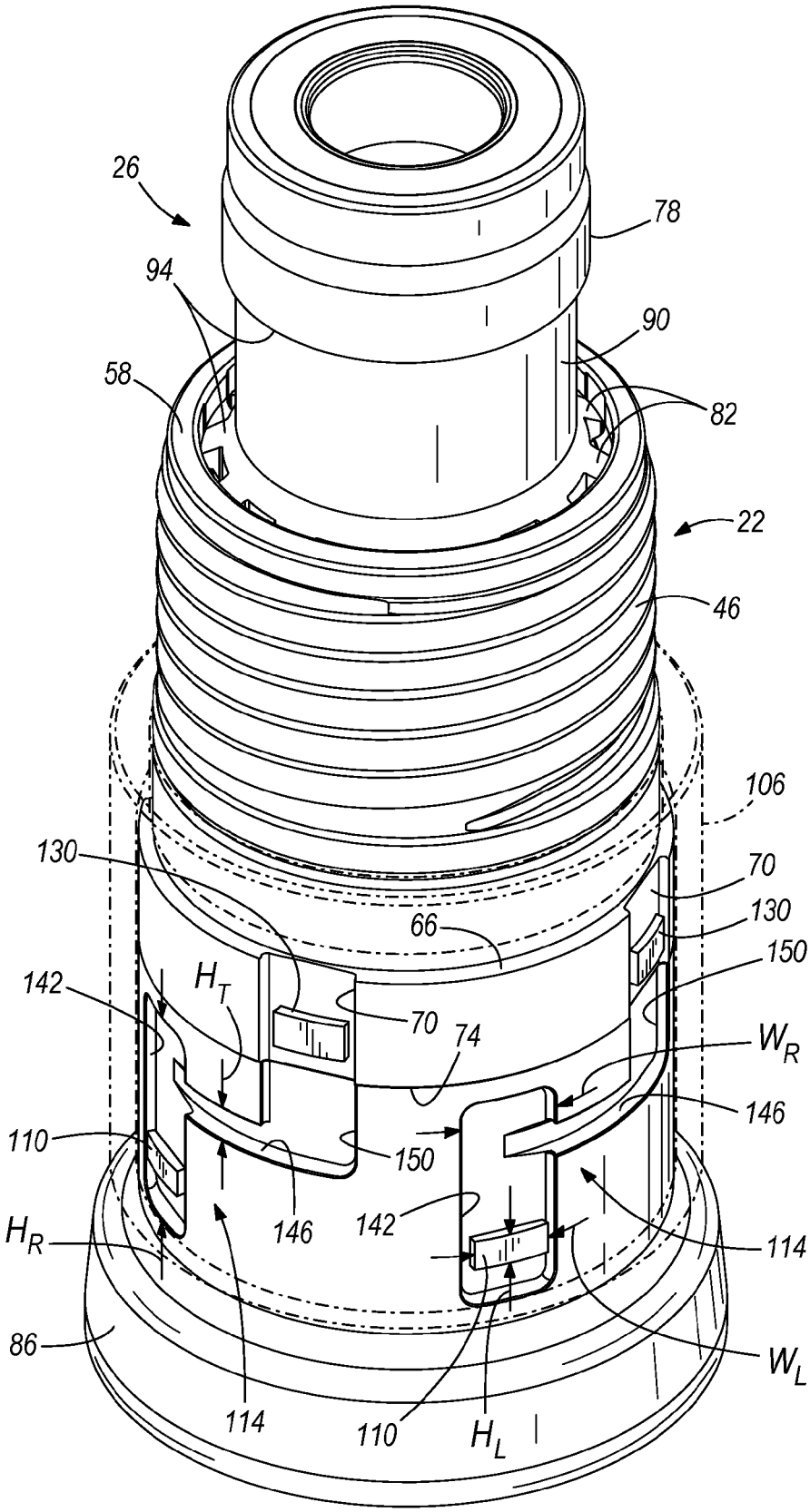
FIG. 4 is a perspective view of the portion of the drill assembly shown in FIG. 1 with the sleeve shown in phantom.

A down-hole drill assembly 10 is partially illustrated in the drawings. For the sake of simplicity and consistency, the term "axial" means in a direction along or parallel to a central axis 14 of the drill assembly 10 illustrated in the drawings. The elements of the drill assembly 10 discussed below are generally ring-shaped or cylindrical and therefore all have inner and outer surfaces. The term "inner surface" means the surface facing toward the central axis 14 or generally toward the inside of the drill assembly 10, and the term "outer surface" means the surface facing away from the central axis 14 or generally away from the inside of the drill assembly 10. All elements also have first and second ends which, using the convention of the illustrated construction, will be referred to as "top" and "bottom" ends with respect to the typical operating orientation of the drill assembly 10, which orientation is illustrated in FIG. 4. Also, terms such as "above", "elevated", "below", etc., describe a relative position while the drill assembly 10 is in the typical operating orientation.

The drill assembly 10 may have both rotary and impact aspects to the drilling operation or may be embodied in a pure down-the-hole ("DTH") drill arrangement in which there is no rotary component. The drill assembly 10 may use substantially any type of drill bit, including a standard bit, drag bit, rotary bit, or another cutting surface suitable for or adaptable to impact loading.

In the illustrated construction, the drill assembly 10 generally includes a casing 18 (shown in FIG. 3), a chuck 22, a bit 26 and a retainer assembly 30 operable to retain and retrieve a broken portion of the bit 26. The casing 18 defines a central bore 34 (see FIG. 3) for guiding a piston mechanism (not shown). The piston mechanism may be any type of piston mechanism usable in a drill assembly and, for example, may be similar to that shown in U.S. Patent Application Publication No. 2008/0078584 A1, published Apr. 3, 2008, and in U.S. patent application Ser. No. 12/369,579, filed Feb. 11, 2009, the entire contents of which are hereby incorporated by references.

Figure 1:
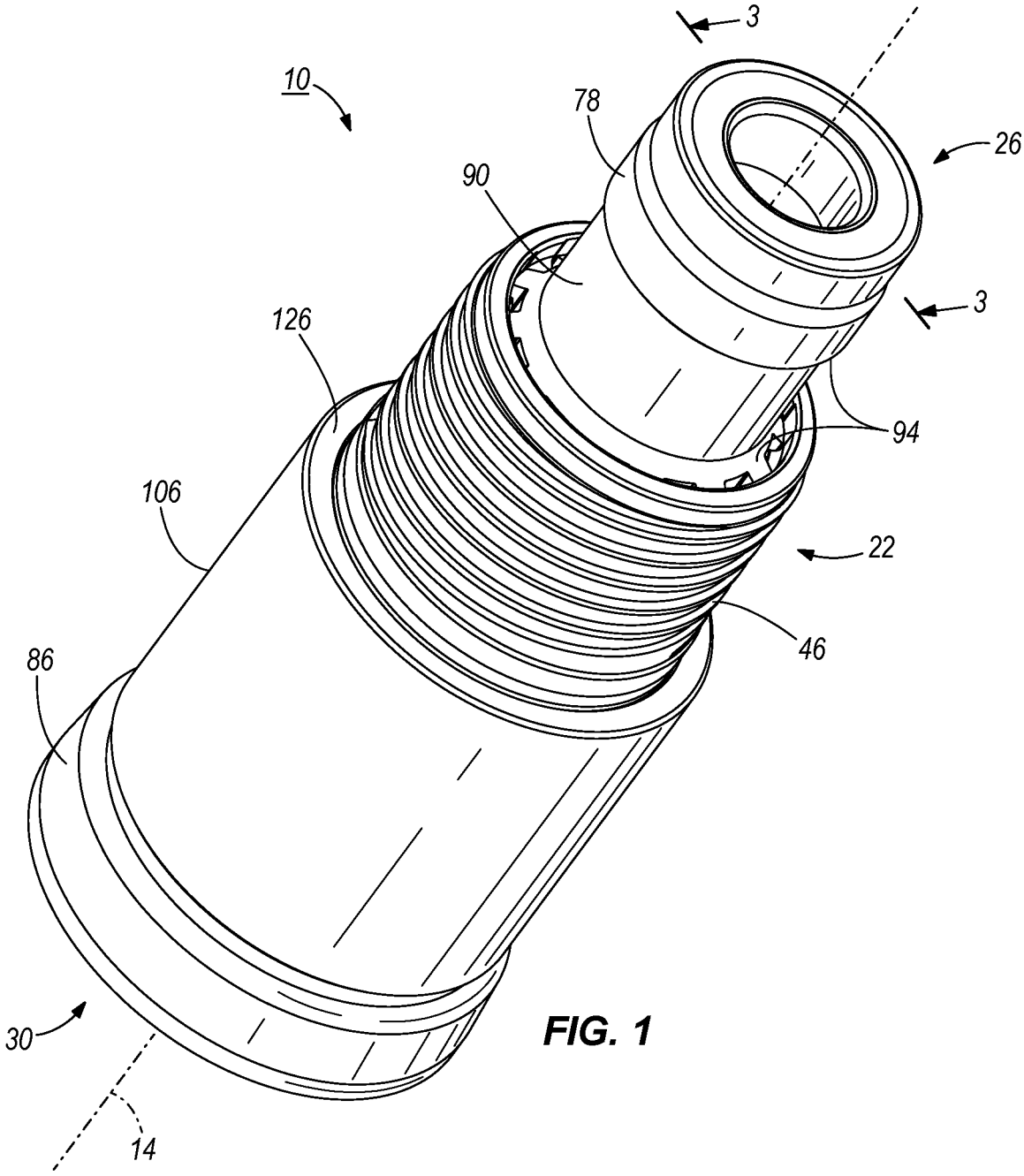
FIG. 1 is a perspective view of a portion of a drill assembly including a chuck assembly and a retainer assembly.
Figure 2:
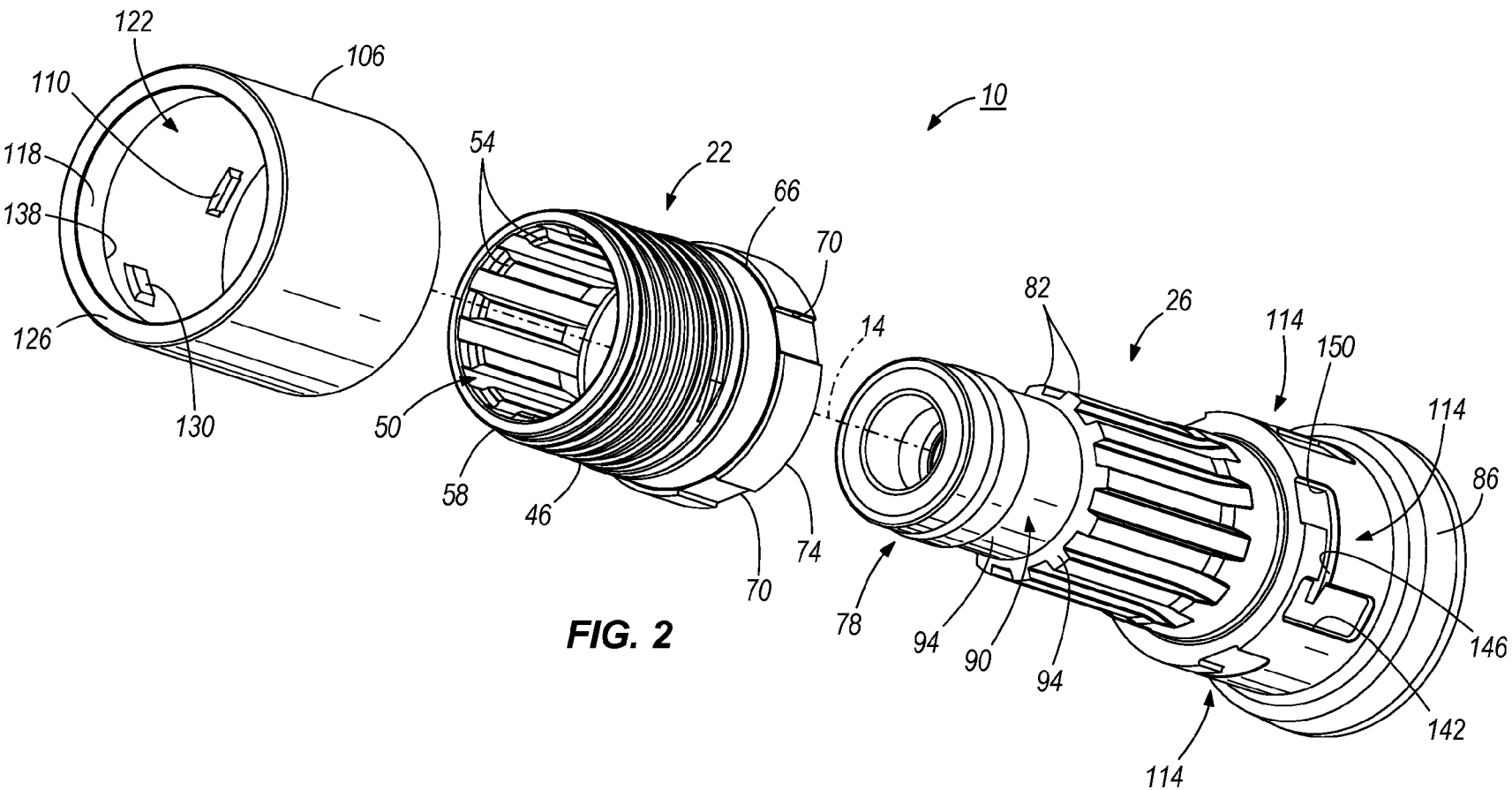
FIG. 2 is an exploded perspective view of the portion of the drill assembly shown in FIG. 1.
Figure 3:
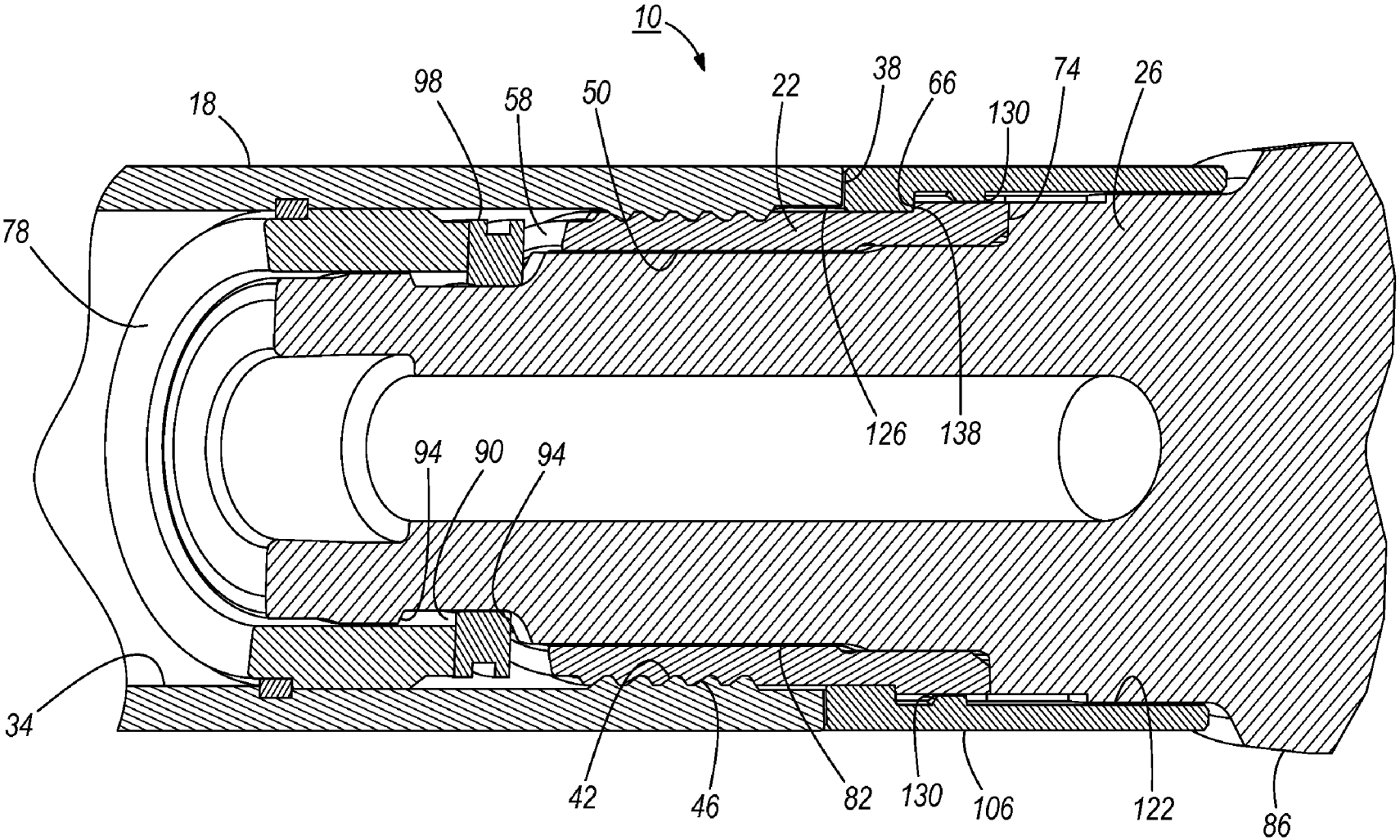
FIG. 3 is a cross-sectional perspective view of the portion of the drill assembly shown in FIG. 1 with additional components.

The casing 18 has a bottom end surface 38, and internal threads 42 are defined proximate the bottom end. As shown in FIGS. 1-3, the chuck 22 has outer threads 46 which mate with the threads 42 to connect the chuck 22 to the casing 18.

The chuck 22 defines (see FIG. 2) a chuck bore 50 and internal splines 54 extending from the upper end 58. An outer shoulder 66 is provided on the outer surface of the chuck 22. A number of slots 70 (four in the illustrated construction) extend axially between the outer shoulder 66 to the bottom end 74.

The bit 26 generally includes a shank 78 providing an anvil, an intermediate portion with external splines 82, and a head 86 having an exterior working surface to bear against rock or other material to be drilled. The bit shank 78 defines an annular groove 90 providing oppositely-facing stopping surfaces 94. When the bit 26 is assembled into the chuck 22, a split ring 98 (see FIG. 3) is positioned in the annular groove 90 to connect the bit 26 to the chuck 22 for drilling operations.

In the illustrated construction, the bit 26 is integrally formed to include the shank 78, intermediate portion and the head 86. In other constructions (not shown), the bit 26 could be formed as a bit retainer having suitable connecting apparatus for receiving a rotary drill bit (e.g., a tricone) or other suitable work piece for rock drilling.

As shown in FIGS. 2 and 4-8, the retainer assembly 30 generally includes a retainer sleeve 106 and an arrangement of inter-engaging lug(s) 110 and slot(s) 114. The sleeve 106 has an inner wall 118 defining a central bore 122. In the illustrated construction, the inner wall 118 of the sleeve 106 is machined to be formed with four (4) lugs 110, and the outer surface of the bit head 86 is formed with four (4) corresponding slots 114. As described below in more detail, each lug 110 is engageable in a corresponding slot 114. In the illustrated construction, the lugs 110 and slots 114 are equally spaced about the circumference of the sleeve 106 and the bit head 86, respectively.

It should be understood that fewer or more than four (4) lugs 110 and slots 114 may be provided. Also, in other constructions (not shown), the lug(s) 110 may be provided on the bit head 86, and the slot(s) 114 may be provided on the sleeve 106. In addition, corresponding numbers of lug(s) 110 and slot(s) 114 could be formed on each of the bit head 86 and the other structure (e.g., the sleeve 106). Further, in other constructions (not shown), a sleeve 106 may not be provided, and the lug(s) 110 and/or the slot(s) 114 may be provided on another structure (e.g., on a portion of the chuck 22).

It should be understood that the lug(s) 110 may be separate from and connectable (e.g., by welding) to the supporting structure (e.g., to the sleeve 106 or to the bit head 86). Also, in other constructions (not shown), the lug(s) 110 and the slot(s) 114 may be un-equally spaced about the circumference of and/or staggered along the axis of the sleeve 106 and the bit head 86, respectively, such that the lug(s) 110 and slot(s) 114 are only engageable in a limited number (e.g., one) of rotational positions of the bit head 86 relative to the sleeve 106.

The sleeve 106 also includes one or more drive lugs 130 and an inner shoulder 138. In the illustrated construction, the inner wall 118 of the sleeve 106 is also machined to be formed with four (4) drive lugs 130, and the chuck 22 is formed with four (4) corresponding slots 70. As described below in more detail, each lug 130 is engageable in a corresponding slot 70, and the inner shoulder 138 is engageable with the outer shoulder 66. In the illustrated construction, the lugs 130 are equally spaced about the circumference of the sleeve 106, and the slots 70 are equally spaced about the circumference of the chuck 22.

It should be understood that fewer or more than four (4) lugs 130 and slots 70 may be provided. Also, in other constructions (not shown), the lug(s) 130 may be provided on the chuck 22, and the slot(s) 70 may be provided on the sleeve 106. In addition, corresponding numbers of lug(s) 130 and slot(s) 70 could be formed on each of the chuck 22 and the other structure (e.g., the sleeve 106). Further, in other constructions (not shown), a sleeve 106 may not be provided, and the lug(s) 130 and/or the slot(s) 70 may be provided on another structure.

It should be understood that the lug(s) 130 may be separate from and connectable (e.g., by welding) to the supporting structure (e.g., to the sleeve 106 or to the chuck 22). Also, in other constructions (not shown), the lug(s) 130 and the slot(s) 70 may be un-equally spaced about the circumference of and/or staggered along the axis of the sleeve 106 and the chuck 22, respectively, such that the lug(s) 130 and slot(s) 70 are only engageable in a limited number (e.g., one) of rotational positions of the chuck 22 relative to the sleeve 106.

In the illustrated construction, each slot 114 includes several slot portions including an axial retainer slot 142, a transverse slot 146 and an entry slot 150. The retainer slot 142 has at least one closed end to prevent movement of the lug 110 from at least that end of the retainer slot 142. As shown in FIGS. 5-8, the retainer slot 142 has opposite side walls 154 and 158 and opposite end walls 162 and 166. One side wall (e.g., side wall 154) defines an opening 170. One end wall (e.g., the upper end wall 162) provides the at least one retainer end wall engageable with a surface of the lug 110 to prevent movement of the lug 110 from that end of the retainer slot 142.

The transverse slot 146 communicates with the retainer slot 142 through the opening 170 in the side wall 154. The entry slot 150 has at least one open end to allow movement of the lug 110 into/out of at least that end of the entry slot 150. The entry slot 150 has an entry port or open axial end 174 providing the at least one open end. The entry slot 150 communicates with the transverse slot 146 proximate its closed axial end 178. In the illustrated construction, each slot 114 generally has the shape of a reversed "4".

In other constructions (not shown), each slot 114 may include fewer or more slot portions. For example, each slot 114 may include only a retainer slot 142 with an opening 170 for passage of the lug 110 into the retainer slot 142. In other constructions (not shown), each slot 114 may have a "J" shape.

To assemble, the bit shank 78 is inserted into the chuck bore 50, and the splines 54 and 82 are engaged or mesh such that torque may be transmitted from the chuck 22 to the bit 26. The split ring 98 is positioned in the annular groove 90 to connect the bit 26 to the chuck 22. For normal operations, axial movement is provided between the bit 26 and the chuck 22 while the splines 54 and 82 remain in torque-transmitting engagement. Engagement of the split ring 98 with the opposite stopping surfaces 94 limits this axial movement.

After (or before) connection of the bit 26 and the chuck 22, the sleeve 106 is lowered axially onto upper end 58 the chuck 22. Each lug 110 passes axially through an associated slot 70 in the outer surface of the chuck 22. Engagement of the inner shoulder 138 on the sleeve 106 with the outer shoulder 66 on the chuck 22 prevents further downward axial movement of the sleeve 106 relative to the chuck 22.

Figure 5:
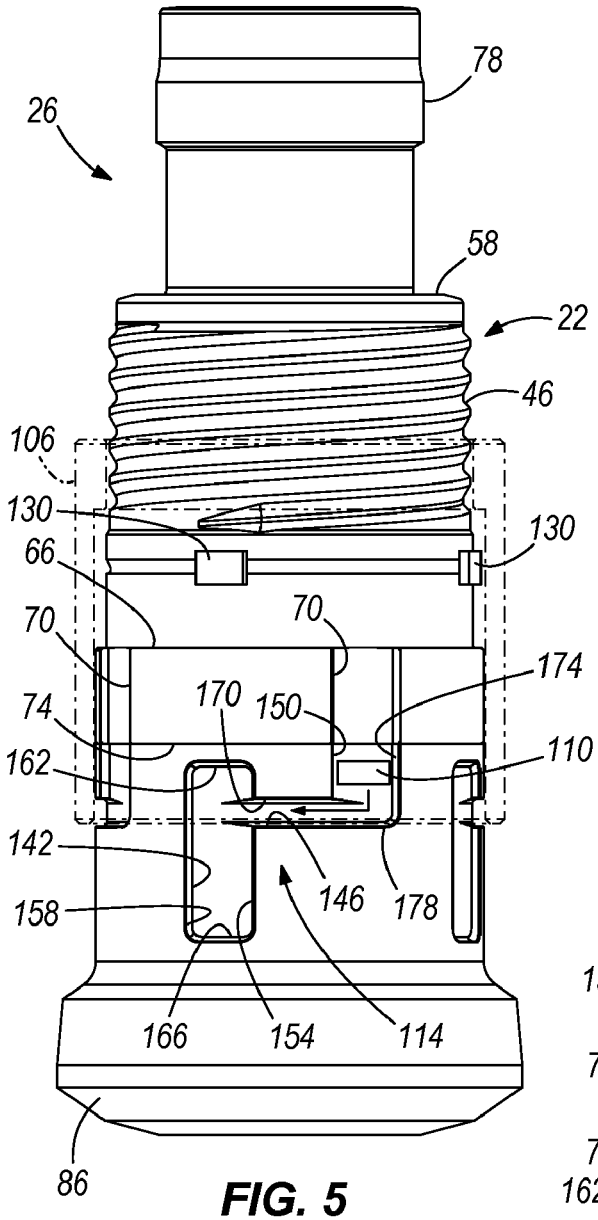
FIG. 5 is a side view of the portion of the drill assembly shown in FIG. 4 and illustrating engagement of a retainer lug in a slot.
Figure 6:
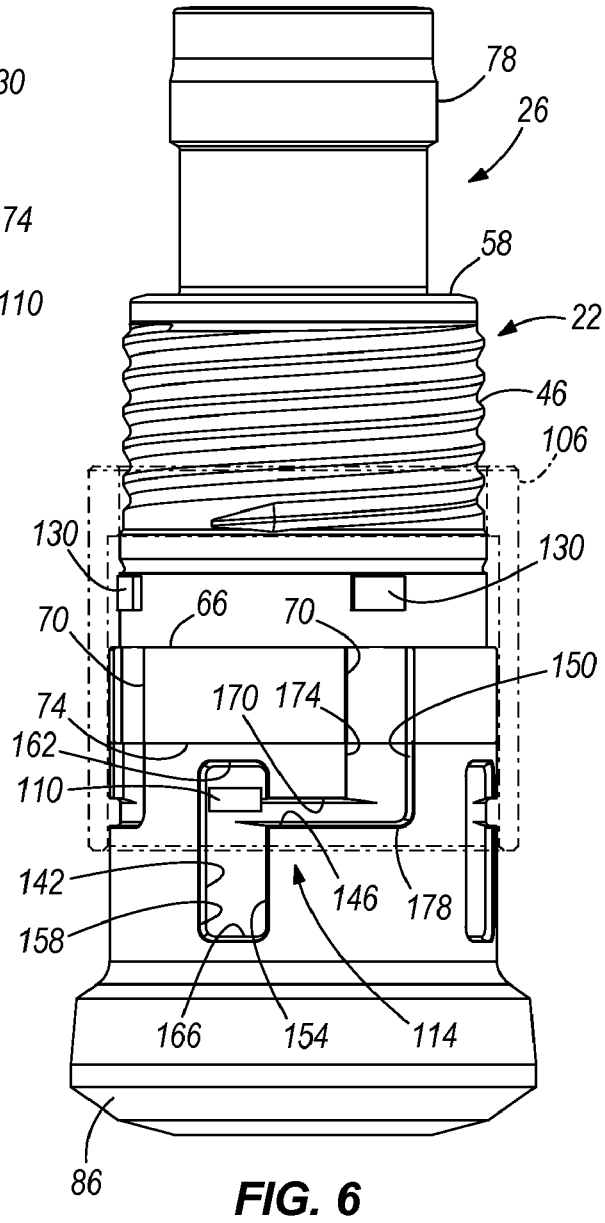
FIG. 6 is a side view similar to FIG. 5 and illustrating the retainer lug in a retainer slot.

To engage the retainer assembly 30, each lug 110 enters the open axial end 174 of the entry slot 150 of its associated slot 114 and moves toward the closed axial end 178 as the bit 26 and sleeve 106 are moved axially relative to one another (as shown in FIG. 5). With the lug 110 proximate the closed axial end 178, the bit 26 and sleeve 106 are relatively rotated or angularly displaced so that the lug 110 enters the transverse slot 146. The relative rotation continues until the lug 110 passes through the opening 170 and into the retainer slot 142 (as shown in FIG. 6). In this rotational position, each lug 130 is axially aligned with a corresponding slot 70. In the illustrated construction, rotation of the sleeve 106 relative to the bit 26 is in the direction of normal rotation of the drill assembly 10.

Figure 7:
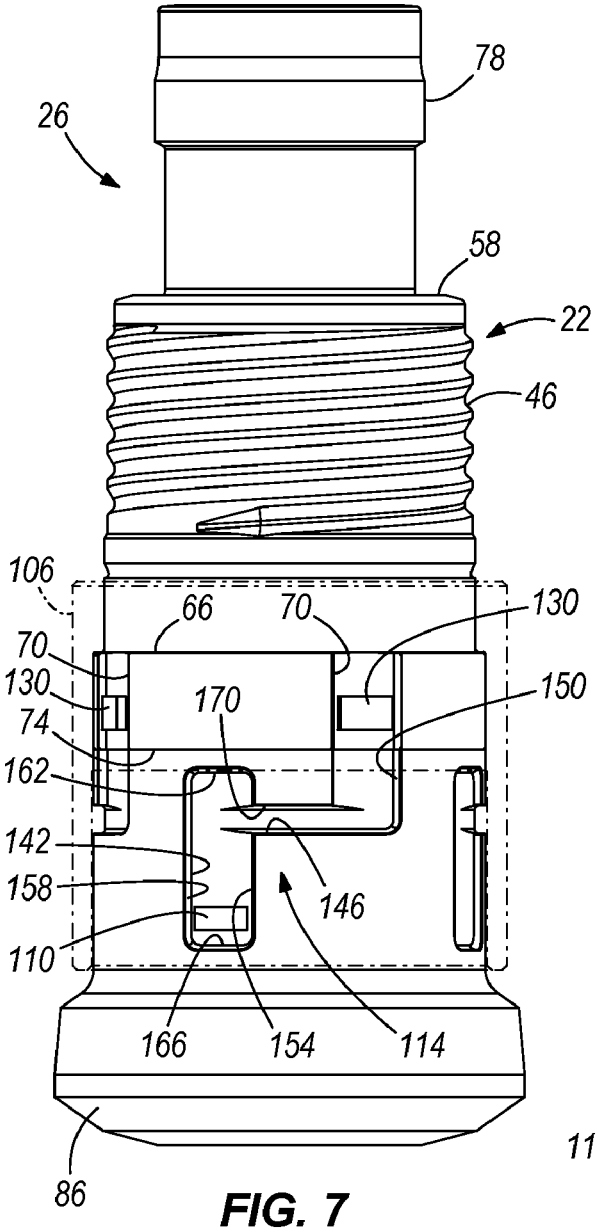
FIG. 7 is a side view similar to FIG. 5 and illustrating engagement of a drive lug in a chuck slot and the retainer lug in the retainer slot with the drill assembly in an operating condition.
Figure 8:
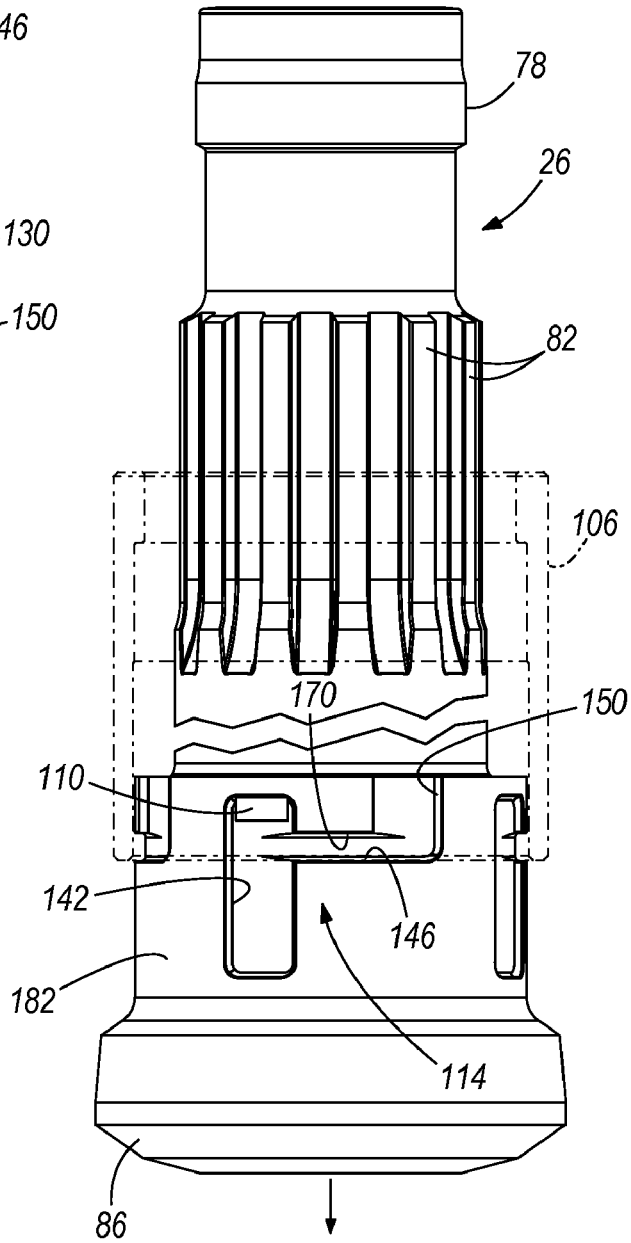
FIG. 8 is a side view similar to FIG. 5 with the chuck removed and illustrating engagement of the retainer lug with the retainer surface to retain a broken portion of the bit.

Once the lug 110 is fully in the retainer slot 142, the bit 26 may move axially relative to the sleeve 106 and relative to the chuck 22 (as shown in FIGS. 6-8). To limit relative rotational movement between the sleeve 106 and the chuck 22, each lug 130 engages a corresponding slot 70.

With the chuck 22, the bit 26 and the retainer assembly 30 assembled, the unit is connected to the casing 18 by threading the chuck threads 46 into the casing threads 42 (as shown in FIG. 3). The bottom end surface 38 of the casing 18 engages the upper end surface 126 of the sleeve 106 to clamp the sleeve 106 in position.

Operation of the drill assembly 10 is explained with partial reference to FIGS. 6-8. When the bit head 86 is not being pushed against rock and the bit 26 is simply subject to forces arising from gravity, the bit 26 is extended downwardly and bottoms out with the upper stopping surface 94 resting on top of the split ring 98. In this standby condition of the drill assembly 10, the lug 110 is generally in the position in the retainer slot 142 shown in FIG. 6 with the lug 110 axially offset from the opening 170. As such, the lug 110 is prevented from inadvertently disengaging the retainer slot 142 through the opening 170.

With reference to FIG. 7, when the bit head 86 is engaged against rock, the bit 26 is pushed upwardly and tops out with the lower stopping surface 94 abutting the bottom of the split ring 98 and the top of the bit head 86 bearing against the bottom end 74 of the chuck 22. In this operating condition of the drill assembly 10, the lug 110 is generally in the position in the retainer slot 142 shown in FIG. 7.

In operation, the drill assembly 10 has a rotary component (at least to change the engagement of teeth on the bit 26 with the bottom of the hole) and a percussive component. The impact of a piston (not shown) of the piston mechanism on the bit 26 is transmitted to the rock or other material being drilled, and the bit 26 moves axially in the chuck 22.

If the bit 26 fails during drilling operations, failure typically occurs in the shank 78 at the split ring 98, in the splines 82 or at the interface between the intermediate portion and the bit head 86. With such a failure, (see FIG. 8) the broken portion 182 of the bit 26 is no longer supported by engagement of the annular groove 90 with the split ring 98 and drops downwardly. However, the broken portion 182 is retained with the drill assembly 10 through engagement of the retainer assembly 30 and thereby may be retrieved from the hole.

As shown in FIG. 8, the upper surface of the lug 110 engages the retainer surface of the retainer slot 142 provided by the upper end wall 162 preventing the broken portion 182 from further downward movement and from disconnecting from the drill assembly 10. In this position, the lug 110 is trapped in the upper portion of the retainer slot 142, preventing disengagement while the drill assembly 10 is removed from the hole.

After operation of the drill assembly 10, removal of the chuck 22 from the casing 18 is facilitated through rotation of the sleeve 106. Because each drive lug 130 is engaged in the corresponding slot 70, rotation of the sleeve 106 causes rotation of the chuck 22 to unscrew the chuck threads 46 from the casing threads 42. Engagement of the drive lug(s) 130 and the slot(s) 70 provide a driving arrangement between the sleeve 106 and the chuck 22. Such a driving arrangement may be especially useful when the bit 26 fails because the broken portion 182 of the bit 26 is free from rotational engagement with the chuck 22. However, the driving arrangement may also be useful for removal of the chuck 22 in the absence of bit failure and/or for connection of the unit to the casing 18 before operation.

As shown in FIG. 4, each lug 110 has an axial height $H_L$. In the illustrated construction, the transverse slot 146 has an axial height $H_T$ which fits closely to the height $H_L$ of the lug 110 to reduce the likelihood that the lug 110 may inadvertently (e.g., during normal operation of the drilling assembly 10) move circumferentially from (e.g., disengage) the retainer slot 142, through the opening 170 and into the transverse slot 146. The height $H_T$ of the transverse slot 146 may be between about 5% and about 50% larger and, in the illustrated construction, is about 20% larger than the height $H_L$ of the lug 110. The opening 170 may have the same axial height as the transverse slot 146. The opening 170 may also be approximately square to further resist accidental disengagement of the lug 110 from the retainer slot 142.

In other constructions (not shown), the opening 170 may have a smaller axial height than the transverse slot 146. The transverse slot 146 may taper in height from the entry slot 150 toward the retainer slot 142.

The lug 110 and the retainer slot 142 are dimensioned and/or positioned on the supporting components (e.g., on the sleeve 106 and the bit 26) such that the lug 110 and the retainer slot 142 do not support and/or drive the bit 26 during operations. This arrangement ensures proper driving and/or support of the bit 26 while preventing wear and/or damage to the lug 110, the slot 114 and/or the supporting structure (the bit head 86 and the sleeve 106).

The retainer slot 142 has an axial height $H_R$ which is greater than the total of the height of the lug $H_L$ and the total axial movement of the bit 26 during drilling operations (as defined by the stopping surfaces 94 and the split ring 98). As shown in FIG. 6, the upper surface of the lug 110 will not engage the upper end wall 162 when the bit 26 is not engaged with the rock, and, as shown in FIG. 7, the lower surface of the lug 110 will not engage the lower end wall 166 when the bit head 86 is engaged against the rock. The lug 110 will only engage the retainer slot 142 (the retainer surface of the upper end wall 162) when the bit 26 is broken.

Each lug 110 has a circumferential width $W_L$. In the illustrated construction, the retainer slot 142 has a larger circumferential width $W_R$ such that the lug 110 will not engage the side walls 154 and 158 during normal operation of the drill assembly 10 (e.g., due to backlash in the splines 54 and 82). The width $W_R$ is at least larger than the total of the width $W_L$ of the lug 110 and the maximum circumferential movement in each direction of the bit head 86 relative to the sleeve 106. The circumferential width of the entry slot 146 may also be larger than the width $W_L$ of the lug 110 (as shown) to allow easy assembly or may fit more closely to the circumferential width $W_L$ of the lug 110.

In the illustrated construction, each lug 130 is sized to closely fit within a slot 70. Also, each lug 130 generally has a height to provide sufficient engagement with the slot 70 to facilitate removal of the chuck 22.

In an alternative construction, for example, as shown in Ser. No. 12/425,222, filed Apr. 16, 2009, incorporated by reference above, key recesses (not shown) may be provided on the sleeve 106 and the chuck 22, and a key or pin (not shown) may be positioned in the recesses to limit relative rotation between the sleeve 106 and the chuck 22.

A driving arrangement of the lug(s) 108 and slot(s) 70 may be used in other constructions of a bit retainer or in chuck assemblies without a bit retainer as shown, for example, in U.S. Pat. Nos. 5,647,447; 5,699,867; and 4,706,764; the contents of all of which are hereby incorporated by reference.

One independent advantage of the present drill assembly 10 and retainer assembly 30 may be to provide structure to retain and retrieve a broken portion 182 of a bit 26. Such structure may be simple and/or inexpensive to manufacture, assemble and/or operate. Such structure may have improved operational reliability. An independent advantage of a driving arrangement of the lug(s) 130 and slot(s) 70 may be to provide easier removal of the chuck 22 from the casing 18.

Thus, the invention provides, among other things, a chuck assembly for an earth-boring drill assembly. The invention also provides an assembly for an earth-boring drill assembly. In addition, the invention provides a method of retaining a drill bit for an earth-boring drill assembly. Various independent features and independent advantages of the invention are set forth in the following claims.

What is claimed is:

1. A chuck assembly for an earth-boring drill assembly, the drill assembly including a casing having a central axis, and an earth-boring bit, the chuck assembly comprising:

a chuck connectable to the casing and operable to support the earth-boring bit, the chuck having an outer surface with a radially-outwardly extending chuck shoulder; and an annular sleeve positionable on the chuck, the sleeve having an inner surface with a radially-inwardly extending sleeve shoulder engageable with the chuck shoulder to limit axial movement of the sleeve relative to the chuck;

one of the chuck and the sleeve defining an axially-extending slot, the other of the chuck and the sleeve having a lug, the lug being positionable in the slot to limit relative rotational movement between the sleeve and the chuck.

2. The chuck assembly of claim 1, wherein the lug has a width, and wherein the slot is sized to closely fit the width of the lug.

3. The chuck assembly of claim 1, wherein the chuck defines the axially-extending slot in the chuck shoulder, and wherein the sleeve supports the lug on the inner surface.

4. The chuck assembly of claim 3, wherein the chuck defines a plurality of axially-extending slots in the chuck shoulder, the plurality of axially-extending slots being spaced about a circumference of the chuck, and wherein the sleeve supports a plurality of lugs on the inner surface, the plurality of lugs being spaced about a circumference of the inner surface of the sleeve to correspond to positions of the plurality of axially-extending slots, each of the plurality of lugs being positionable in a corresponding one of the plurality of axially-extending slots.

5. The chuck assembly of claim 4, wherein the chuck defines four axially-extending slots, and wherein the sleeve supports four lugs, each lug being positionable in a corresponding axially-extending slot.

6. The chuck assembly of claim 3, wherein the chuck defines an axially-extending first chuck slot and an axially-extending second chuck slot in the chuck shoulder, the first chuck slot and the second chuck slot being spaced about a circumference of the chuck, and wherein the sleeve supports a first lug and a second lug, the first lug being positionable in the first chuck slot and the second lug being positionable in the second chuck slot.

7. The chuck assembly of claim 1 further comprising a bit retainer assembly that includes a retainer lug supported by the sleeve and a retainer slot defined by the bit; wherein the retainer slot has an axially-extending side wall defining an opening and an axial end wall, and wherein the retainer lug is positionable in the retainer slot through the opening in the side wall, the retainer lug being engageable with the end wall to restrict axial movement of the bit from the sleeve and away from the casing.

8. The chuck assembly of claim 1, further comprising a bit retainer assembly that includes a retainer lug supported by the bit and a retainer slot defined by the sleeve; wherein the retainer slot has an axially-extending side wall defining an opening and an axial end wall, and wherein the retainer lug is positionable in the retainer slot through the opening in the side wall, the retainer lug being engageable with the end wall to restrict axial movement of the bit from the sleeve and away from the casing.

9. An assembly for an earth-boring drill assembly, the drill assembly including a casing having a central axis, the assembly comprising:

a drill bit including a generally cylindrical head;

a chuck connectable to the casing and operable to support the bit, the chuck having an outer surface with a radially-outwardly extending chuck shoulder;

a sleeve having an inner surface with a radially-inwardly extending sleeve shoulder engageable with the chuck shoulder to limit axial movement of the sleeve relative to the chuck, one of the chuck and the sleeve defining an axially-extending first slot, the other of the chuck and the sleeve having a first lug, the first lug being positionable in the first slot to limit relative rotational movement between the sleeve and the chuck; and a retainer assembly provided between the sleeve and the bit, the retainer assembly including an axial retainer slot defined by one of the sleeve and the bit, the retainer slot having an axially-extending side wall defining an opening and an axial end wall, and a retainer lug supported on the other of the sleeve and the bit, the retainer lug being positionable in the retainer slot through the opening in the side wall, the retainer lug being engageable with the end wall to restrict axial movement of the bit from the sleeve and away from the casing.

10. The assembly of claim 9, wherein the chuck defines the axially-extending first slot in the chuck shoulder, and wherein the sleeve supports the first lug on the inner surface.

11. The assembly of claim 10, wherein the bit defines the retainer slot, and wherein the sleeve supports the retainer lug.

12. The assembly of claim 11, wherein the first lug is circumferentially spaced from the retainer lug by at least about 30 degrees.

13. The assembly of claim 11, wherein the first lug is circumferentially spaced from the retainer lug by about 45 degrees.

14. The assembly of claim 11, wherein the first lug is axially spaced from the retainer lug.

15. The assembly of claim 11, wherein the chuck defines a plurality of axially-extending first slots in the chuck shoulder, the plurality of axially-extending first slots being spaced about a circumference of the chuck, and wherein the sleeve supports a plurality of first lugs on the inner surface, the plurality of first lugs being spaced about a circumference of the inner surface of the sleeve to correspond to positions of the plurality of axially-extending first slots, each of the plurality of first lugs being positionable in a corresponding one of the plurality of axially-extending first slots.

16. The assembly of claim 15, wherein the bit defines a plurality of axially-extending retainer slots, the plurality of axially-extending retainer slots being spaced about a circumference of the bit, and wherein the sleeve supports a plurality of retainer lugs on the inner surface, the plurality of retainer lugs being spaced about a circumference of the inner surface of the sleeve to correspond to positions of the plurality of axially-extending retainer slots, each of the plurality of retainer lugs being positionable in a corresponding one of the plurality of axially-extending retainer slots.

17. The assembly of claim 11, wherein the chuck defines four axially-extending first slots in the chuck shoulder, the axially-extending first slots being substantially equally spaced about the circumference of the chuck, and wherein the sleeve supports four first lugs, the first lugs being substantially equally spaced about the circumference of the inner surface of the sleeve, each first lug being positionable in a corresponding axially-extending first slot.

18. The assembly of claim 17, wherein the bit defines four axially-extending retainer slots, the axially-extending retainer slots being substantially equally spaced about the circumference of the bit, and wherein the sleeve supports four retainer lugs, the retainer lugs being substantially equally spaced about the circumference of the inner surface of the sleeve, each retainer lug being positionable in a corresponding axially-extending retainer slot.

19. The assembly of claim 18, wherein the first lugs and the retainer lugs are offset by about 45 degrees.

20. The assembly of claim 11, wherein the chuck defines an axially-extending first chuck slot and an axially-extending second chuck slot in the chuck shoulder, the first chuck slot and the second chuck slot being spaced about a circumference of the chuck, and wherein the sleeve supports a first sleeve lug and a second sleeve lug, the first sleeve lug being positionable in the first chuck slot and the second sleeve lug being positionable in the second chuck slot.

21. The assembly of claim 11, wherein the retainer lug passes through the first slot before being positioned in the retainer slot.

22. The assembly of claim 21, wherein the retainer assembly further includes an entry slot defined by the bit and communicating with the first slot, the retainer lug passing through the first slot and into the entry slot.

23. The assembly of claim 22, wherein the retainer assembly further includes a transverse slot communicating between the entry slot and the retainer slot, the transverse slot extending at least partially circumferentially about the bit, the transverse slot communicating with the retainer slot through the opening in the side wall of the retainer slot, the retainer lug being movable from the entry slot, into and through the transverse slot, and into the retainer slot.

24. A method of retaining a drill bit for an earth-boring drill assembly, the drill assembly including a casing having a central axis, a drill bit including a generally cylindrical head, a chuck having an outer surface with a radially-outwardly extending chuck shoulder, an axially-extending first slot being defined in the shoulder, a sleeve having an inner surface with a radially-inwardly extending sleeve shoulder and a first lug supported on the inner surface, and a retainer assembly including an axial retainer slot defined by one of the sleeve and the bit, the retainer slot having an axially-extending side wall defining an opening and an axial end wall, and a retainer lug supported on the other of the sleeve and the bit, the method comprising the steps of:

(a) connecting the bit to the chuck;

(b) positioning the sleeve on the chuck, the chuck being connectable to the casing;

(c) engaging the retainer assembly including positioning the retainer lug in the retainer slot through the opening in the side wall, the retainer lug being engageable with the end wall to restrict axial movement of the bit from the sleeve and away from the casing; and (d) engaging the first lug in the first slot to limit relative rotational movement between the sleeve and the chuck.

* * * * *